US007603982B2

(12) United States Patent
Sugiyama et al.

(10) Patent No.: US 7,603,982 B2
(45) Date of Patent: Oct. 20, 2009

(54) CAPACITOR DISCHARGE ENGINE IGNITION DEVICE

(75) Inventors: Masayuki Sugiyama, Numazu (JP); Yasukazu Hatano, Numazu (JP); Akira Shimoyama, Numazu (JP)

(73) Assignee: Kokusan Denki Co., Ltd., Shizuoka-ken (JP)

( * ) Notice: Subject to any disclaimer, the term of this patent is extended or adjusted under 35 U.S.C. 154(b) by 0 days.

(21) Appl. No.: 12/271,470

(22) Filed: Nov. 14, 2008

(65) Prior Publication Data

US 2009/0126686 A1 May 21, 2009

(30) Foreign Application Priority Data

Nov. 16, 2007 (JP) ..... 2007-297496

(51) Int. Cl.
*F02P 5/15* (2006.01)

(52) U.S. Cl. ..... 123/406.57; 123/605

(58) Field of Classification Search ..... 123/406.11, 123/406.56, 406.57, 149 D, 599–601, 605, 123/634, 644; 310/153, 156.14
See application file for complete search history.

(56) References Cited

U.S. PATENT DOCUMENTS 5,829,421 A * 11/1998 McLeod ..... 123/599
5,931,137 A * 8/1999 McLeod et al. ..... 123/406.57
6,691,689 B2 * 2/2004 Kiessling ..... 123/603
6,830,015 B2 * 12/2004 Venturoli et al. ..... 123/41 E
6,889,677 B2 * 5/2005 Fujima et al. ..... 123/600
6,932,064 B1 * 8/2005 Kolak et al. ..... 123/605
7,472,688 B2 * 1/2009 Nakauchi et al. ..... 123/406.53
7,546,836 B2 * 6/2009 Andersson et al. ..... 123/605
7,552,714 B2 * 6/2009 Maier et al. ..... 123/406.58

FOREIGN PATENT DOCUMENTS

JP 10-196503 A 7/1998
JP 2002-161843 A 6/2002
JP 2006-097525 A 4/2006

* cited by examiner

*Primary Examiner*—Stephen K Cronin
*Assistant Examiner*—Johnny H Hoang
(74) *Attorney, Agent, or Firm*—Pearne & Gordon LLP

(57) ABSTRACT

A capacitor discharge ignition device in which a coil unit including an ignition coil and an exciter coil wound around a common core, and an ignition unit including a circuit board and components of an ignition circuit mounted to the circuit board are housed in a case and molded with resin poured into the case, wherein the ignition coil and the exciter coil are placed axially with a spacing therebetween and a space is formed between the coils, the circuit board of the ignition unit is placed on a lateral side of the coil unit, and terminals for connecting the ignition coil and the exciter coil to the circuit board are all connected to the circuit board through the space between the ignition coil and the exciter coil.

12 Claims, 5 Drawing Sheets

CAPACITOR DISCHARGE ENGINE IGNITION DEVICE

TECHNICAL FIELD OF THE INVENTION

The present invention relates to a capacitor discharge engine ignition device.

PRIOR ART OF THE INVENTION

An ignition device of an engine is comprised of an ignition coil, and an ignition unit that controls a current to flow through a primary coil of the ignition coil so as to induce a high voltage for ignition in a secondary coil thereof at ignition timing of the engine. The ignition device of the engine needs to have weatherization, and generally, as disclosed in Japanese Patent Application Laid-Open Publication No. 2002-161843, an ignition coil and an ignition unit are housed in a case and are molded with resin poured into the case.

A capacitor discharge engine ignition device includes an ignition coil, an ignition power supply portion, an ignition capacitor provided on a primary side of the ignition coil, a capacitor charging circuit that charges the ignition capacitor with an output of the ignition power supply portion, a discharge circuit that conducts when receiving an ignition signal and discharges charges accumulated in the ignition capacitor through the primary coil of the ignition coil, and an ignition timing control circuit that controls timing for providing the ignition signal to the discharge circuit. In such an ignition device, the ignition capacitor and components of the capacitor charging circuit, the discharge circuit and the ignition timing control circuit are mounted to a circuit board to comprise an ignition unit.

In the capacitor discharge ignition device, the ignition capacitor is charged to one polarity with an output of the ignition power supply portion. When an ignition signal is provided from the ignition timing control circuit to the discharge circuit at ignition timing of the engine, charges in the ignition capacitor are discharged through the primary coil of the ignition coil, and the discharge causes a discharge current with a sharp leading edge to flow through the primary coil of the ignition coil. A significant change in magnetic flux that occurs in a core when the discharge current flows induces a high voltage for ignition in a secondary coil of the ignition coil. The high voltage for ignition is applied to an ignition plug mounted to a cylinder of the engine, and thus spark discharge occurs in a discharge gap of the ignition plug to ignite the engine.

As the ignition power supply portion, an exciter coil provided on a stator of a magneto generator mounted to the engine is often used. When an inner magnet type magneto rotor having a permanent magnet mounted to an inner periphery of a flywheel is used as a rotor of the magneto generator mounted to the engine, the exciter coil is placed inside the rotor together with other armature coils of the magneto generator, and a unit having a structure in which the ignition coil and the ignition unit are housed in a case and molded with resin is placed outside the magneto generator.

On the other hand, when an outer magnet type magnet rotor having a permanent magnet on an outer periphery of the flywheel is used as the magneto generator mounted to the engine, an exciter coil is wound around a core having at opposite ends thereof magnetic pole portions facing magnetic poles of the magnet rotor, and the exciter coil is placed outside the magneto rotor. With such a construction, as disclosed in Japanese Patent Application Laid-open Publication No. 10-196503, the exciter coil and the ignition coil are wound around a common core and comprise a coil unit and the coil unit is housed in a case together with an ignition unit and molded with resin for a compact construction of the ignition device.

In a coil unit used in such a conventional ignition device, as disclosed in Japanese Patent Application Laid-open Publication No. 10-196503, a coil winding bobbin in which a coil winding portion around which a primary coil of an ignition coil is wound, and a coil winding portion around which an exciter coil is wound are provided axially in parallel is used, and the primary coil of the ignition coil and the exciter coil are wound axially in parallel, or as disclosed in Japanese Patent Application Laid-open Publication No. 2006-97525 (see FIG. 8), an ignition coil and an exciter coil wound around different bobbins are placed adjacent to each other axially in parallel, and mounted to a common leg of a core.

In the conventional ignition devices disclosed in Japanese Patent Application Laid-open Publication No. 10-196503 and Japanese Patent Application Laid-open Publication No. 2006-97525 (see FIG. 8), the exciter coil and the ignition coil are wound adjacent to each other around the same core. Thus, it becomes apparent that an induced voltage of the ignition coil is influenced by an induced voltage of the exciter coil, and as compared with the case where the exciter coil and the ignition coil are wound around different cores, a high voltage for ignition induced in a secondary coil of the ignition coil is reduced to reduce ignition performance.

In the conventional engine ignition device, a plurality of terminals drawn out from the exciter coil and the ignition coil are provided in different positions axially of the coil unit, which makes troublesome an operation of inserting the plurality of terminals into holes in a circuit board, and inevitably reduces assembly operation efficiency of the device. Also, when the plurality of terminals drawn out from the exciter coil and the ignition coil are placed in separate positions, a moving distance of a tool in successively soldering a series of soldering portions becomes long to reduce operation efficiency in a robotic or manual soldering operation between the terminals and a terminal pattern on the circuit board, thereby preventing a reduction in production costs.

SUMMARY OF THE INVENTION

An object of the present invention is to provide a capacitor discharge engine ignition device in which a coil unit comprised of an ignition coil and an exciter coil wound around a common core, and an ignition unit including a circuit board to which components of an ignition circuit are mounted are housed in a common case and molded with resin, and prevent a reduction in high voltage for ignition induced in a secondary coil of the ignition coil by an influence of an induced voltage of the exciter coil.

Another object of the present invention is to provide a capacitor discharge engine ignition device in which a coil unit and an ignition unit are housed in a common case and molded with resin, and facilitate connection between the coil unit and the ignition unit by collectively placing, in one position, terminals drawn out from the exciter coil and the ignition coil for connecting the coils to a circuit board of the ignition unit.

The capacitor discharge ignition device according to the present invention includes: a coil unit; an ignition unit; and a case housing the coil unit and the ignition unit. The coil unit includes a core having a magnetic pole portion for being faced to a magnetic pole on a magneto rotor driven by an engine, an exciter coil that is wound around the core and induces an AC voltage in synchronization with rotation of the engine, and an ignition coil placed in parallel with the exciter coil and wound around the core. The coil unit is housed in the case with the magnetic pole portion of the core placed outside the case.

The ignition unit includes an ignition capacitor, a capacitor charging circuit that charges the ignition capacitor with an output of the exciter coil, a discharge circuit that discharges charges accumulated in the ignition capacitor through a primary coil of the ignition coil when receiving an ignition signal, and an ignition timing control circuit that controls timing for providing the ignition signal to the discharge circuit, and the ignition capacitor and components of the capacitor charging circuit, the discharge circuit and the ignition timing control circuit are mounted to the circuit board. The ignition unit is placed on a lateral side of the coil unit in the case with a surface of the circuit board directed in parallel with an axis of the coil unit.

In the present invention, the exciter coil and the ignition coil are placed axially with a spacing therebetween and a space is formed between the exciter coil and the ignition coil, a plurality of ignition coil connection terminals drawn out from the ignition coil for connecting the ignition coil to the circuit board and a plurality of exciter coil connection terminals drawn out from the exciter coil for connecting the exciter coil to the circuit board are drawn out toward the circuit board through the space between the ignition coil and the exciter coil and connected to the circuit board. The coil unit and the ignition unit are molded with resin poured into the case.

As described above, it was confirmed that the ignition coil and the exciter coil are placed with the spacing therebetween and the space is formed between the coils to prevent a reduction in high voltage for ignition induced in the secondary coil of the ignition coil.

The high voltage for ignition induced in the secondary coil of the ignition coil is reduced when the ignition coil and the exciter coil are wound around the common core, probably because a change in magnetic flux that occurs in the core by discharge of the charges in the ignition capacitor induces a voltage for ignition in the secondary coil of the ignition coil and simultaneously induces a high voltage in the exciter coil to cause the exciter coil to generate magnetic flux, and the magnetic flux acts to prevent a change in magnetic flux interlinking with the secondary coil of the ignition coil. According to the present invention, the ignition coil and the exciter coil are separately placed to reduce mutual inductance between the coils and prevent the magnetic flux generated from the exciter coil from interlinking with the ignition coil, thereby preventing a reduction in high voltage for ignition induced in the secondary coil of the ignition coil.

A size of the space between the ignition coil and the exciter coil is experimentally determined so that the reduction in high voltage for ignition induced in the secondary coil of the ignition coil falls within an acceptable range in discharge of the ignition capacitor. Specifically, an experiment for calculating a relationship between a difference between the high voltage for ignition induced in the secondary coil of the ignition coil when the ignition coil and the exciter coil are wound around the common core and the high voltage for ignition induced in the secondary coil of the ignition coil when the ignition coil and the exciter coil are wound around different cores, and the size of the space between the ignition coil and the exciter coil is performed to determine the size of the space between the ignition coil and the exciter coil so that the difference in voltage calculated by the experiment falls within an acceptable range.

As described above, the plurality of ignition coil connection terminals drawn out from the ignition coil and the exciter connection terminals drawn out from the exciter coil are all drawn out toward the circuit board through the space between the ignition coil and the exciter coil, and thus soldering portions between the coil unit and the circuit board of the ignition unit can be collectively placed in one position axially of the coil unit, thereby facilitating an operation of inserting the plurality of connection terminals drawn out from the coil unit into holes in the circuit board and increasing assembly operation efficiency.

As described above, the plurality of ignition coil connection terminals and the exciter connection terminal are all drawn out toward the circuit board through the space between the ignition coil and the exciter coil, and thus the soldering portions between the coil unit and the circuit board of the ignition unit can be collectively placed in one position axially of the coil unit, thereby reducing a moving distance of a tool in soldering the series of soldering portions to increase soldering operation efficiency.

In a preferred aspect of the present invention, the exciter coil is wound around an exciter winding bobbin including a first flange and a second flange at one and the other axial ends, and the exciter winding bobbin is mounted to an outer periphery of the core with the first flange placed on one end side of the core. A primary bobbin having first and second flange portions at one and the other ends is provided, the first flange portion having a larger diameter than the second flange portion, and the primary coil is wound around the primary bobbin. The primary bobbin is mounted to the outer periphery of the core together with the exciter winding bobbin, and the first flange portion faces the second flange of the exciter winding bobbin with a space therebetween.

Further, a secondary bobbin including a barrel surrounding the primary coil and the second flange portion of the primary bobbin, and one end side flange portion and the other end side flange portion formed at one and the other axial ends of the barrel is provided, and the secondary coil of the ignition coil is wound around the barrel of the secondary bobbin. The secondary bobbin is placed outside the primary coil, and one end side flange portion is abutted against the first flange portion of the primary bobbin.

The plurality of ignition coil connection terminals and the plurality of exciter coil connection terminals are supported by the first flange portion of the primary bobbin and the second flange of the exciter winding bobbin, respectively.

The plurality of exciter coil connection terminals and the plurality of ignition coil connection terminals are drawn out toward the circuit board through the space between the first flange portion of the primary bobbin and the second flange of the exciter winding bobbin and connected to the circuit board.

In a preferred aspect of the present invention, the primary bobbin integrally includes a boss protruding from a portion closer to the core of the first flange portion toward the exciter winding bobbin, and the boss is abutted against the exciter winding bobbin to maintain the space between the first flange portion of the primary bobbin and the second flange of the exciter winding bobbin.

In another preferred aspect of the present invention, the exciter winding bobbin integrally includes a boss protruding from a portion closer to the core of the second flange toward the primary bobbin, and the boss is abutted against the primary bobbin to maintain the space between the first flange portion of the primary bobbin and the second flange of the exciter winding bobbin.

The plurality of exciter coil connection terminals and the plurality of ignition coil connection terminals are preferably drawn out toward the circuit board with tips thereof arranged in line on one plane perpendicular to an axis of the coil unit.

The plurality of ignition coil connection terminals generally include a primary coil side ground terminal drawn out from one end on a ground side of the primary coil of the ignition coil and a secondary coil side ground terminal drawn out from one end on a ground side of the secondary coil of the ignition coil. In this case, the primary coil side ground terminal and the secondary coil side ground terminal are preferably placed adjacent to each other.

As described above, according to the present invention, the space is formed between the ignition coil and the exciter coil to reduce mutual inductance between the primary coil of the ignition coil and the exciter coil, and the magnetic flux generated from the exciter coil when the charges in the ignition capacitor discharge through the primary coil of the ignition coil is prevented from acting to prevent a change in magnetic flux interlinking with the ignition coil, thereby preventing a reduction in high voltage for ignition induced in the secondary coil of the ignition coil.

Also according to the present invention, the plurality of ignition coil connection terminals drawn out from the ignition coil and the exciter coil connection terminals drawn out from the exciter coil for connecting the exciter coil to the circuit board are all drawn out toward the circuit board through the space between the ignition coil and the exciter coil, and the soldering portions between the coil unit and the circuit board of the ignition unit are collectively placed in one position axially of the coil unit, thereby facilitating an operation of inserting the series of connection terminals into holes in the circuit board, and reducing a moving distance of a tool in a soldering operation therebetween to increase soldering operation efficiency. This can increase production efficiency of the ignition device and reduce costs thereof.

BRIEF DESCRIPTION OF THE DRAWINGS

The above and other objects and features of the invention will be apparent from the detailed description of the preferred embodiments of the invention, which is described and illustrated with reference to the accompanying drawings, in which.

DETAILED DESCRIPTION OF THE PREFERRED EMBODIMENTS

Figure 1:
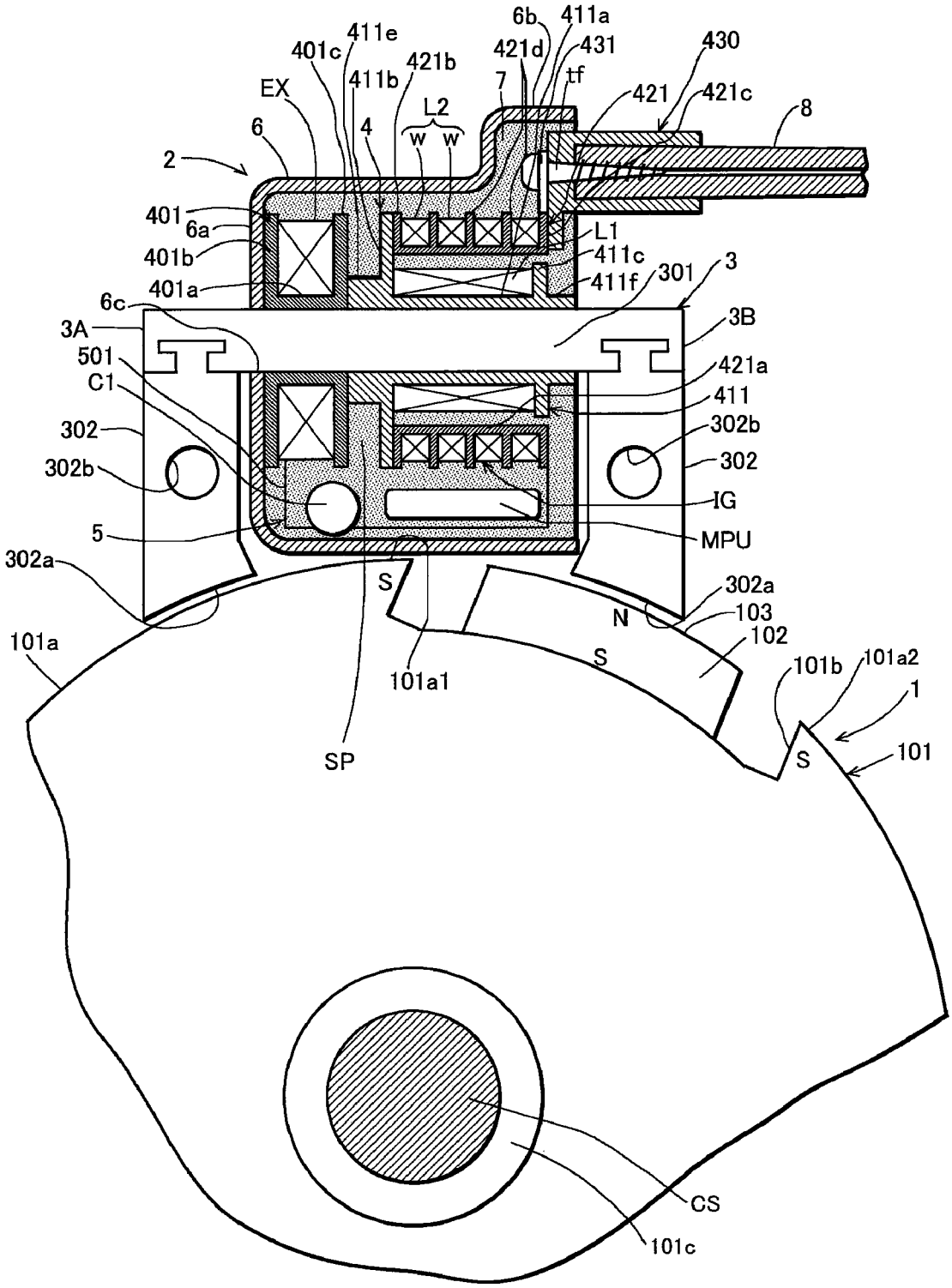
FIG. 1 is a sectional view of a construction of essential portions of an embodiment of the present invention.

In FIG. 1, a reference numeral 1 denotes an outer magnet type magneto rotor that is mounted to a crankshaft of an unshown engine and cooperates with an ignition device according to the present invention, and 2 denotes the ignition device according to the present invention.

The magneto rotor 1 is comprised of a flywheel 101 made of ferromagnetic material such as iron and having a cylindrical outer peripheral surface 101*a*, and an arcuate permanent magnet 102 mounted in a recess 101*b* formed in the outer peripheral surface of the flywheel 101. The permanent magnet 102 is magnetized so that a magnetizing direction is a radial direction of the flywheel 101. In the shown example, a magnetic pole surface on a radially outer periphery of the permanent magnet 102 is a north pole, and south poles of the magnet are led out to outer peripheral surfaces 101*a*1 and 101*a*2 of the flywheel near opposite ends of the recess 101*b* facing circumferentially of the flywheel. The magnetic pole (north pole) on the outer periphery of the permanent magnet 102 and two south poles led out to the outer peripheral surface of the flywheel near the opposite ends of the recess 101*b* produce a three-pole magnetic field. A boss 101*c* is provided at an axis of the flywheel 101, and the boss is fitted to a crankshaft CS of the engine and thus the magneto rotor 1 is mounted to the crankshaft CS.

The shown ignition device 2 is comprised of a core 3, a coil unit 4 wound around the core 3, an ignition unit 5 comprised by mounting a microprocessor MPU and an ignition capacitor C to a circuit board 501 (see FIG. 4), a resin case 6 housing the coil unit 4 and the ignition unit 5, and resin 7 poured into the case 6.

The core 3 is formed of laminated steel sheets into a U-shape by an I-shaped coil winding portion 301 and a pair of legs 302 and 302 mounted to opposite ends of the coil winding portion 301 by dovetail connection, and magnetic pole portions 302*a* and 302*a* facing the magnetic pole of the magneto rotor are formed at tips of the legs 302 and 302. The pair of legs 302 and 302 have mounting holes 302*b* and 302*b* through which screws for securing the ignition device to the engine are passed.

The coil unit 4 is comprised of an exciter coil EX and an ignition coil IG including a primary coil L1 and a secondary coil L2. The exciter coil EX and the ignition coil IG are placed axially with a spacing therebetween and wound around the coil winding portion 301 of the core 3, and a space SP is formed between the exciter coil EX and the ignition coil IG.

The exciter coil EX is wound around a coil winding barrel 401*a* of an exciter winding bobbin 401, which integrally includes the coil winding barrel 401*a* and a first flange 401*b* and a second flange 401*c* formed at one and the other axial ends of the barrel. In the embodiment, a cross-sectional outline of each of the barrel 401*a* and the flanges 401*b* and 401C of the exciter winding bobbin is square with four rounded corners, and the exciter coil EX is wound substantially in a shape of a rectangular parallelepiped. Thus, the exciter coil EX has four side surfaces directed in 90° different directions from each other, and one of the four side surfaces is an ignition unit facing surface Se that faces a main surface of a circuit board of the ignition unit.

The bobbin 401 around which the exciter coil EX is wound is fitted and mounted to an outer periphery of the coil winding portion 301 of the core 3 with the first flange 401*b* positioned at one end 3A of the core 3. To connect the exciter coil to a circuit board 501 of the ignition unit 5, two exciter connection terminals ta and tb are connected to opposite ends of the exciter coil. The exciter connection terminals ta and tb are supported by a second flange 401*c* with parts thereof molded to the second flange 401*c* of the exciter winding bobbin. The exciter connection terminals ta and tb are bent along an outer surface of the second flange 401*c* of the exciter winding bobbin, and drawn out to the ignition unit facing surface Se of the exciter coil EX.

A primary coil L1 of the ignition coil IG is wound around a primary bobbin 411. The primary bobbin 411 integrally includes a primary coil winding barrel 411*a*, a first flange portion 411*b* formed at one axial end of the barrel 411*a*, and a second flange portion 411*c* formed at the other axial end of the barrel 411*a* and having a smaller diameter than the first flange portion, and the primary coil L1 is wound around the barrel 411*a*. The primary bobbin 411 around which the primary coil L1 is wound is fitted and mounted to the outer periphery of the coil winding portion 301 of the core 3 with the first flange portion 411*b* directed toward the second flange 401*c* of the exciter winding bobbin 401. The first flange portion 411*b* of the primary bobbin 411 and the second flange 401*c* of the exciter winding bobbin 401 face each other with a set spacing therebetween, and the space SP is formed between the first flange portion 411*b* and the second flange 401*c*.

In the embodiment, bosses 411*e* and 411*f* protruding toward one end 3A (toward the second flange 401*c* of the exciter winding bobbin 401) and the other end 3B of the core 3 are formed at a portion closer to the core 3 of the first flange portion 411*b* of the primary bobbin 411 and a portion closer to the core of the second flange portion 411*c*, and when the exciter winding bobbin 401 and the primary bobbin 411 are fitted and mounted to the outer periphery of the coil winding portion 301 of the core 3, the boss 411*e* at one end 3A of the core 3 is abutted against the second flange 401*c* of the exciter winding bobbin 401 to form the space SP between the first flange portion 411*b* of the primary bobbin 411 and the second flange 401*c* of the exciter winding bobbin 401.

The secondary coil L2 of the ignition coil is would around a secondary bobbin 421. The secondary bobbin 421 integrally includes a secondary coil winding barrel 421*a* placed to surround an outer periphery of the primary coil L1 and an outer periphery of the second flange portion 411*c* of the primary bobbin 411, one end side flange portion 421*b* and the other end side flange portion 421*c* formed at one and the other axial ends of the secondary coil winding barrel 421*a*, and a plurality of partition walls 421*d*, 421*d*, . . . that partition between one end side flange portion 421*b* and the other end side flange portion 421*c* into a plurality of coil winding grooves axially arranged. Unit coils w, w, . . . are wound around the plurality of coil winding grooves in the secondary bobbin 421 and connected in series, and the secondary coil L2 is comprised of the unit coils w, w, . . . connected in series. The secondary bobbin 421 around which the secondary coil L2 is wound is placed outside the primary coil L1 with one end side flange portion 421*b* abutted against the first flange portion 411*b* of the primary bobbin 411.

Barrels and flange portions of the primary bobbin 411 and the secondary bobbin 421 are formed so that a cross-section of each thereof is square with four rounded corners as in the exciter winding bobbin 401, and the primary coil L1 and the secondary coil L2 are each wound substantially in a shape of a rectangular parallelepiped. Thus, the secondary coil L2 has four side surfaces directed in 90° different directions from each other, and one of the four side surfaces is an ignition unit facing surface Si.

A high-tension code holder 430 is secured to an outer surface of the other end side flange portion 421*c* of the secondary bobbin 421. The high-tension code holder 430 integrally includes a cylindrical portion 430*a* having one open end and a plate-shaped mounting portion 430*b* protruding radially outwardly from the other end of the cylindrical portion 430*a*, and a high-tension code connection terminal tf comprised of a screw is mounted through an end wall formed to block the other end of the cylindrical portion 430*a*. The high-tension code holder 430 is placed with the mounting portion 430*b* abutted against the other end side flange portion 421*c* of the secondary bobbin 421, a positioning protrusion 421*e* (see FIGS. 2 and 4) formed on the other end side flange portion 421*c* of the secondary bobbin is press-fitted into a hole formed in the mounting portion 430*b*, and thus the high-tension code holder 430 is positioned in a predetermined position of the secondary bobbin with the cylindrical portion 430*a* directed axially of the coil unit. The high-tension code connection terminal tf is connected to a winding end of the secondary coil L2 via connection terminal hardware 431. One end of the high-tension code 8 is press-fitted into the cylindrical portion 430*a* of the high-tension code holder 430, the high-tension code connection terminal tf is screwed into a core of the high-tension code, and thus the high-tension code 8 is connected to the winding end of the secondary coil L2.

The secondary bobbin 421 around which the secondary coil L2 is wound is placed so as to surround the outer periphery of the primary coil L1 wound around the primary bobbin 411 and the outer periphery of the second flange portion 411*c* of the primary bobbin 411 to assemble the ignition coil IG, and the ignition coil IG and the exciter coil EX are mounted to the coil winding portion 301 of the core 3 to assemble the coil unit 4.

An ignition coil connection terminal tc connecting to the winding end of the primary coil L1 of the ignition coil, and an ignition coil connection terminal td connecting to a winding start of the primary coil are held with parts thereof embedded in the first flange portion 411*b* of the primary bobbin 411. The ignition coil connection terminals tc and td are bent along the outer surface of the first flange portion 411*b* of the primary bobbin 411 and drawn out toward the ignition unit facing surface Si. An ignition coil connection terminal te connected to a winding start of the secondary coil L2 is provided with part thereof embedded in one end side flange portion 421*b* of the secondary bobbin 421, and the ignition coil connection terminal te passes through the first flange portion 411*b* of the primary bobbin 411 and is drawn out of the first flange portion 411*b*. The ignition coil connection terminal te drawn out of the first flange portion 411*b* is bent along the outer surface of the first flange portion 411*b* and drawn out toward the ignition unit facing surface Si.

Figure 2:
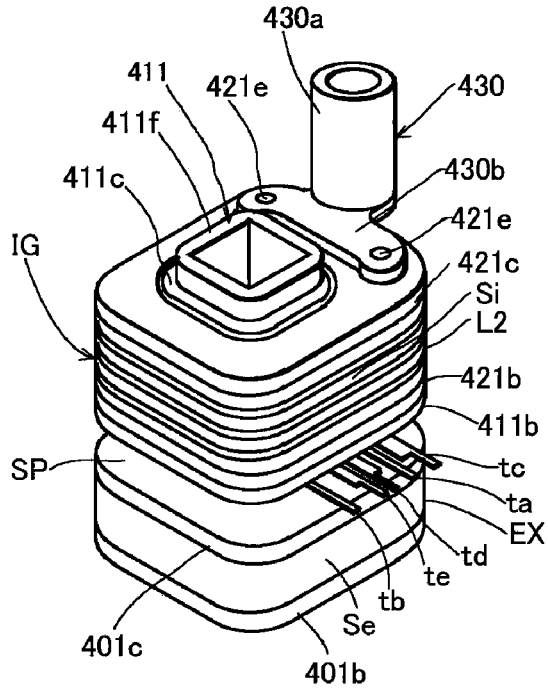
FIG. 2 is a perspective view of a coil unit used in the embodiment.
Figure 3:
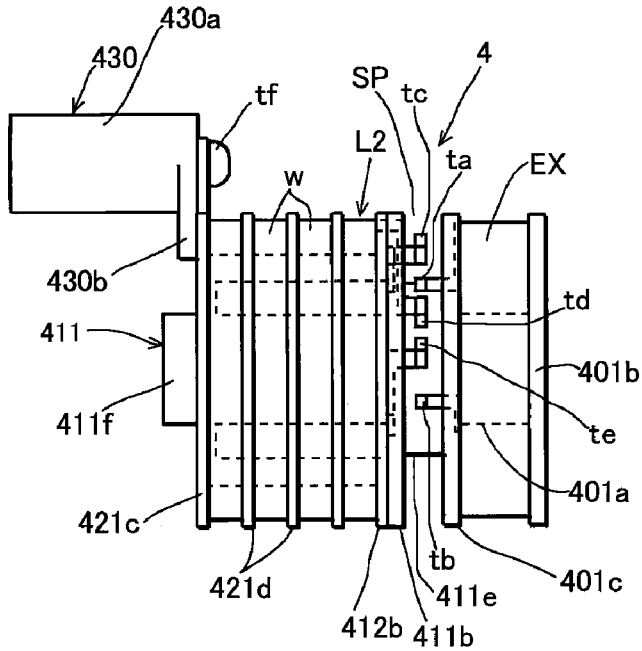
FIG. 3 is a side view of the coil unit used in the embodiment.

As shown in FIG. 2, the exciter connection terminals ta and tb and the ignition coil connection terminals tc and te are provided so that tips (ends connected to the circuit board of the ignition unit) of the terminals are arranged in parallel on one plane perpendicular to the axis of the coil unit 4 with the coil unit 4 assembled, and drawn out in one direction (toward the circuit board of the ignition unit) through a space G between the ignition coil and the exciter coil. Among the ignition coil connection terminals ta to te, the ignition coil connection terminals td and te are ground side terminals of the primary coil and the secondary coil of the ignition coil, and the terminals are placed adjacent (close) to each other. The grounded connection terminals td and te are placed adjacent to each other to allow the connection terminals to be inserted into one large hole in the circuit board 501 and soldered to a ground pattern on the circuit board, thereby reducing the number of soldering portions.

Figure 4:
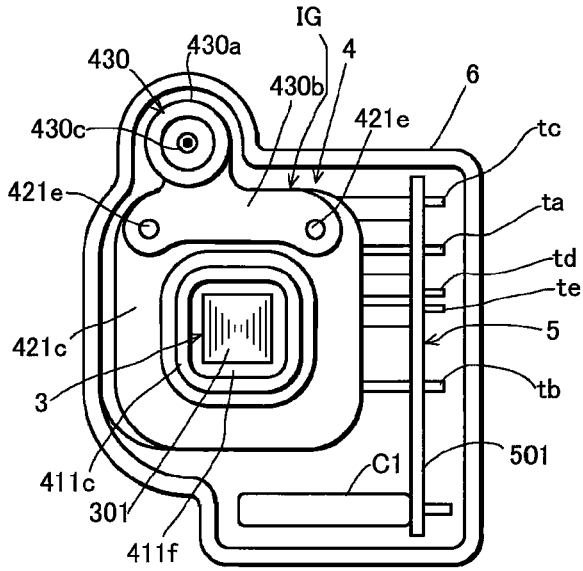
FIG. 4 is a front view, partially in section, of an ignition device according to the embodiment.

As shown in FIG. 4, the circuit board 501 to which components of the ignition unit 5 are mounted is placed on a lateral side of the coil unit 4 with one main surface facing the ignition unit facing surfaces Se and Si. The exciter coil connection terminals ta and tb drawn out from the opposite ends of the exciter coil EX and the ignition coil connection terminals tc to te drawn out from the ignition coil IG are inserted into through holes provided in the circuit board 501, and soldered to a terminal pattern provided on the board. Though not shown in detail in FIG. 4, to the circuit board 501, an ignition capacitor of a capacitor discharge ignition device, components of a capacitor charging circuit, components of a discharge circuit, and components of an ignition timing control circuit are mounted.

The case 6 is formed of a cylindrical member of resin having one end closed by a bottom 6*a* and the other end opening. An expanding portion 6*b* that houses the high-tension code holder 430 is formed in part of a side wall close to the opening end, and a hole 6*c* through which the coil winding portion 301 of the core 3 is passed is formed at the center of the bottom 6*a*.

In assembling the ignition device, the exciter winding bobbin 401 around which the exciter coil EX is wound, and the ignition coil IG comprised by placing the secondary bobbin 421 around which the secondary coil is wound outside the primary bobbin around which the primary coil L1 of the ignition coil is wound are mounted to the coil winding portion 301 of the core 3 with the ignition unit facing surfaces Se and Si directed in the same direction to assemble the coil unit 4. Then, the connection terminals ta to te drawn out from between the flange 401*a* of the exciter winding bobbin 401 and the flange 411*a* of the bobbin 410 are inserted into the through holes in the circuit board 501, and soldered to the terminal pattern on the circuit board.

In the embodiment, the tips of the connection terminals ta to te are arranged in parallel on one plane perpendicular to the axis of the coil unit, and drawn out toward the circuit board through the space SP between the ignition coil and the exciter coil, thereby facilitating an operation of inserting the connection terminals drawn out from the coil unit into the through holes provided in the circuit board.

In the embodiment, the soldering portions between the connection terminals drawn out from the coil unit and the circuit board are collectively placed in an axially intermediate portion of the coil unit, thereby reducing a moving distance of a tool in soldering thereof to increase soldering operation efficiency.

In the embodiment, the ground side terminals td and te of the ignition coil are placed adjacent to each other, and the terminals can be inserted into one hole provided in the circuit board and soldered to the ground pattern on the circuit board at one time, thereby reducing the number of soldering portions.

After the ignition unit 5 is connected to the coil unit 4 as described above, the coil unit 4 together with the ignition unit 5 are housed in the case 6, and the opposite ends of the coil winding portion 301 of the core 3 are protruded outwardly from the case 6. In this state, with the opening of the case 6 kept directed upwardly, resin 7 such as epoxy resin is poured into the case and cured. Thus, the coil unit 4 and the ignition unit 5 are resin molded, and the high-tension code holder 430 is secured to the secondary bobbin. Then, the legs 302 and 302 are mounted to the opposite ends of the coil winding portion 301 of the core 3 to complete the ignition device 2.

The ignition device is positioned so as to have a predetermined positional relationship with the magnetic pole of the magneto rotor 1 so that a phase of the voltage induced in the exciter coil is a phase suitable for an ignition operation in a predetermined ignition position, and secured to the case of the engine or the like by bolts passed through the mounting holes 302*b* and 302*b* provided in the legs 302 and 302 of the core, and the magnetic pole portions 302*a* and 302*a* provided at the tips of the legs 302 and 302 of the core face the outer peripheral surface of the magneto rotor 1 via a predetermined air gap.

Figure 5:
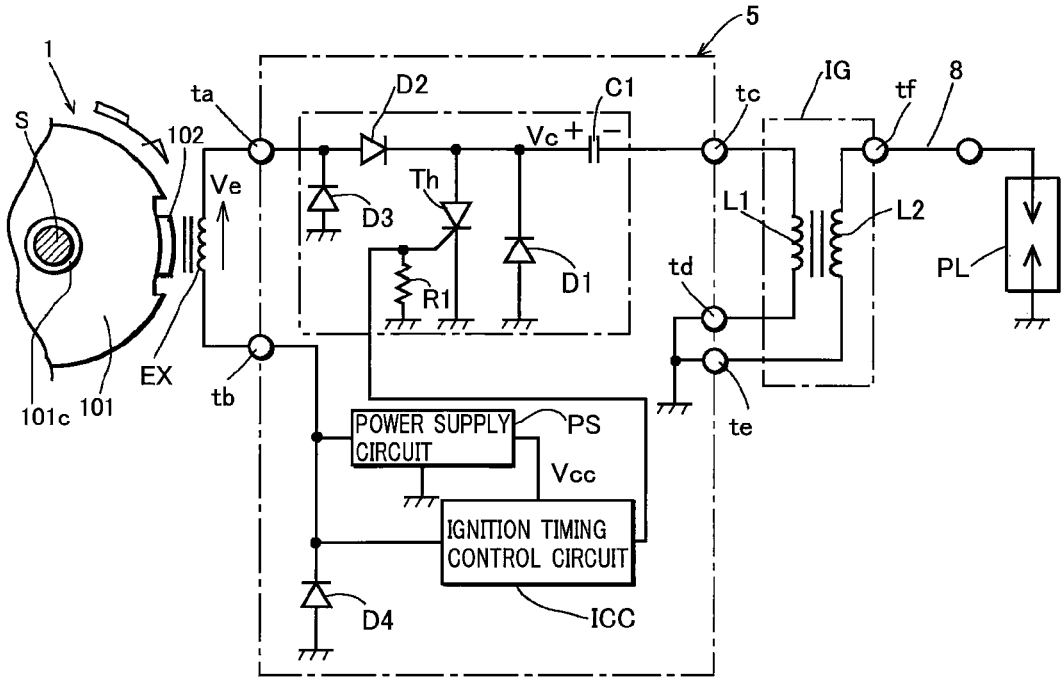
FIG. 5 is a circuit diagram of an electrical construction of the ignition device according to the embodiment.

With reference to FIG. 5, an example of an electrical construction of the ignition unit 5 is shown. In the shown ignition unit 5, one end of an ignition capacitor C1 is connected to a non-ground terminal of the primary coil L1 of the ignition coil IG, and a thyristor Th that functions as a discharge switch is connected between the other end of the ignition capacitor C1 and the ground with a cathode thereof directed to the ground. A diode D1 is connected between an anode and a cathode of the thyristor Th with an anode thereof directed to the ground, and a resistor R1 is connected between a gate and the cathode of the thyristor Th. A cathode of a diode D2 is connected to the other end of the ignition capacitor C1, and the exciter connection terminal ta drawn out from the exciter coil EX is connected to an anode of the diode D2. A diode D3 is connected between the anode of the diode D2 and the ground with an anode thereof directed to the ground. An input port of an ignition timing control circuit ICC including a microprocessor is connected to the other connection terminal tb drawn out from the exciter coil, and an ignition signal Si is inputted to the gate of the thyristor Th from an output port of the ignition timing control circuit ICC. A current feedback diode D4 is connected between the connection terminal tb drawn out from the exciter coil and the ground with an anode thereof directed to the ground. The connection terminal tb is connected to an input terminal of a power supply circuit PS, and a power supply voltage is supplied from the power supply circuit PS to the microprocessor of the ignition timing control circuit ICC. An output voltage (a high voltage for ignition) of the secondary coil L2 of the ignition coil IG is applied to an ignition plug PL provided in one cylinder of the engine through the high-tension code 8.

In the shown example, the capacitor charging circuit that charges the ignition capacitor C1 with an output voltage of the exciter coil is comprised of a circuit of the exciter connection terminal ta—the diode D2—the ignition capacitor C1—the primary coil L1 of the ignition coil—the diode D4—the exciter connection terminal tb, and the discharge circuit of the ignition capacitor C1 is comprised of a circuit of the ignition capacitor C1—the thyristor Th—the primary coil L1 of the ignition coil—the thyristor Th.

The ignition unit 5 is comprised of the capacitor charging circuit, the discharge circuit, the ignition timing control circuit ICC, and the power supply circuit PS, and the capacitor discharge engine ignition device is comprised of the ignition unit 5 and the coil unit 4. When the engine includes two or more cylinders, similarly comprised ignition devices of the same number as the number of the cylinders are provided.

Figures 6A, 6B:
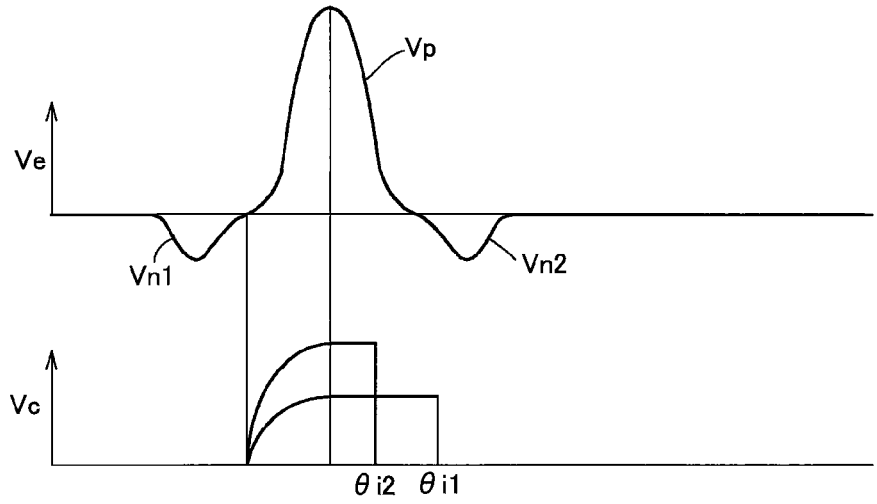
FIGS. 6A and 6B are waveform charts showing waveforms of an induced voltage of an exciter coil of the ignition device in FIG. 5 and a charging voltage of an ignition capacitor.

In the embodiment, when a crankshaft of the engine rotates, an AC voltage Ve is generated in the exciter coil EX as shown in FIG. 6A. The AC voltage Ve is generated once per one turn of the crankshaft at a certain crank angle position determined by a placement position of the ignition device. The AC voltage Ve is a voltage having a waveform with a first negative half wave of a voltage Vn1, a positive half wave of a voltage Vp, and a second negative half wave of a voltage Vn2 appearing in order. The exciter coil EX generates the AC voltage Ve at the certain crank angle position, and thus the waveform of the AC voltage Ve includes crank angle information and rotational speed information of the engine.

The voltages Vn1 and Vn2 of the negative half wave outputted by the exciter coil is converted into a certain DC voltage Vcc by the power supply circuit PS and applied to the microprocessor of the ignition timing control circuit ICC as a power supply voltage. A current flowing from the exciter coil into the power supply circuit PS during the negative half wave of the output of the exciter coil EX is fed back to the exciter coil through the ground circuit and the diode D3.

The ignition timing control circuit ICC starts operating when the power supply voltage is applied from the power supply circuit PS. The ignition timing control circuit ICC uses the crank angle information and the rotational speed information of the engine obtained from the output voltage Ve of the exciter coil EX to arithmetically operate an ignition position (a crank angle position for an ignition operation) at each rotational speed of the engine, and provides an ignition signal Si to the thyristor Th when detecting that the crank angle position of the engine matches the arithmetically operated ignition position.

In the shown ignition unit, when the exciter coil EX outputs the voltage Vp of the positive half wave, the ignition capacitor C1 is charged with the voltage Vp to a shown polarity through the diode D2, the primary coil L1 of the ignition coil, and the diode D4, and a voltage Vc across the ignition capacitor C1 increases as shown in FIG. 6B. Then, when the ignition timing control circuit ICC generates the ignition signal Si in an ignition position θi1, the thyristor Th is turned on. When the thyristor Th is turned on, charges accumulated in the ignition capacitor C1 discharges through the thyristor Th and the primary coil L1 of the ignition coil. Thus, a significant change in magnetic flux occurs in the core 3 to induce a high voltage for ignition in the secondary coil L2 of the ignition coil. The high voltage is applied to the ignition plug PL, and thus spark discharge occurs in the ignition plug PL to ignite and start the engine. The ignition position of the engine is advanced with increase in rotational speed of the engine, and an ignition position at high speed is, for example, θi2 in FIG. 6B.

When the ignition capacitor C1 discharges in the ignition position, the voltage is also induced in the exciter coil EX, and magnetic flux generated from the exciter coil EX is about to prevent a change in magnetic flux interlinking with the secondary coil of the ignition coil. In the present invention, however, the space SP is formed between the exciter coil EX and the ignition coil IG to properly set the size of the space SP, and thus the influence of the magnetic flux generated from the exciter coil on the change in magnetic flux interlinking with the secondary coil of the ignition coil can be reduced, thereby preventing a noticeable reduction in high voltage for ignition induced in the secondary coil of the ignition coil and a reduction in ignition performance.

Figure 7:
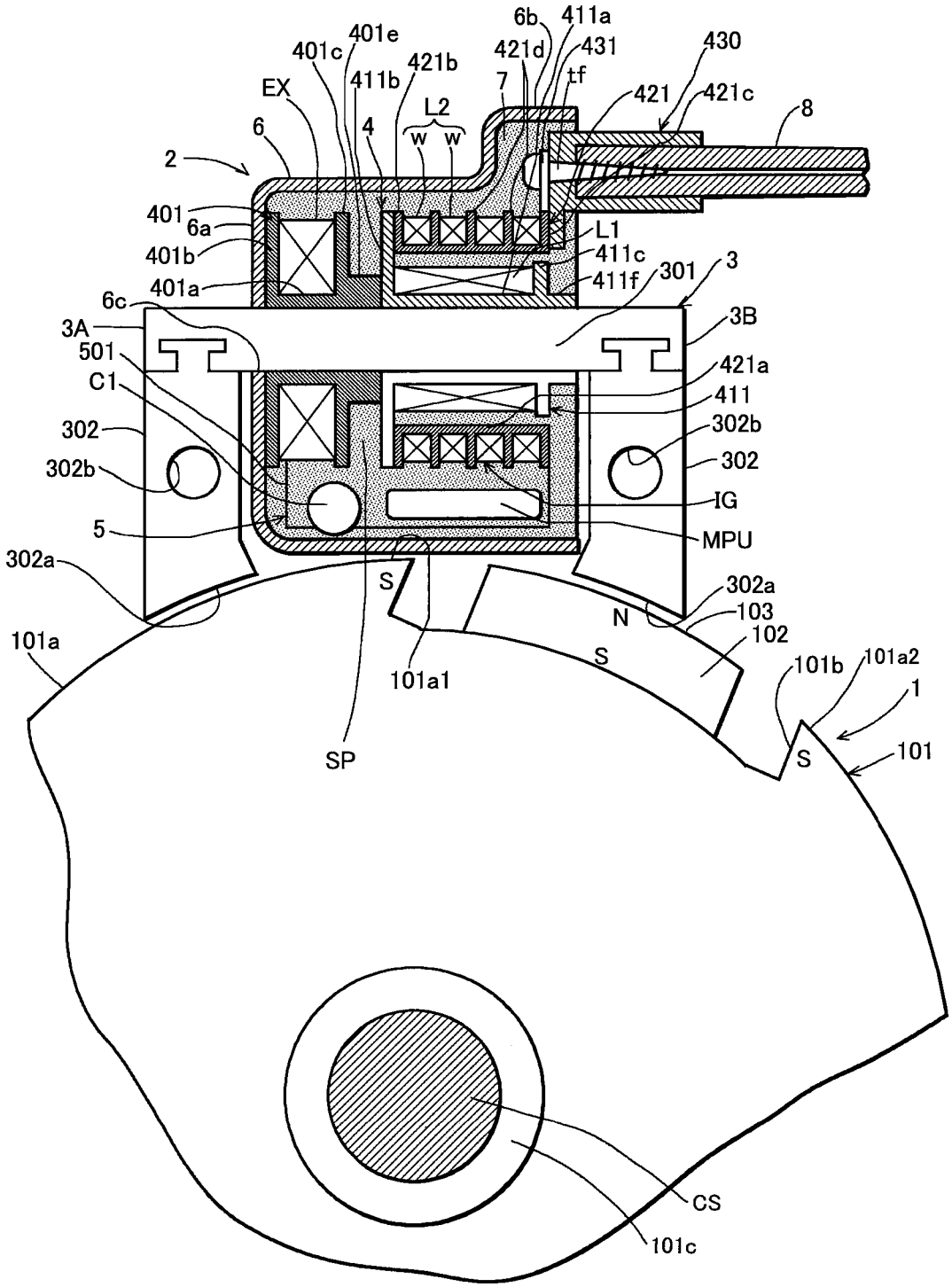
FIG. 7 is a sectional view of a construction of essential portions of another embodiment of the present invention.

In the embodiment, the boss 411*e* provided in the primary bobbin 411 is abutted against the second flange 401*c* of the exciter winding bobbin 401 to form the space SP between the second flange of the exciter winding bobbin and one end side flange portion of the primary bobbin. However, as shown in FIG. 7, it may be allowed that a boss 401*e* protruding from a portion closer to the core of the second flange of the exciter winding bobbin 401 toward the first flange portion 411*b* of the primary bobbin 411 is integrally provided with the exciter winding bobbin 401, and the boss is abutted against the primary bobbin 411 to form a space SP between the first flange portion 411*b* of the primary bobbin and the second flange 401*c* of the exciter winding bobbin.

In the above described embodiment, the Π-shaped core 3 is used, but the present invention may be applied to the case where an E-shaped three-leg core is used and an exciter coil and an ignition coil are wound in parallel around a middle leg of the core as disclosed in Japanese Patent Application Laid-open Publication No. 2006-97525.

Although the preferred embodiments of the invention have been described and illustrated with reference to the accompanying drawings, it will be understood by those skilled in the art that there are by way of examples, and that various changes and modifications may be made without departing from the spirit and scope of the invention, which is defined only to the appended claims.

What is claimed is:

1. A capacitor discharge engine ignition device comprising:

a coil unit;

an ignition unit; and a case housing said coil unit and said ignition unit, wherein said coil unit includes a core having a magnetic pole portion for being faced to a magnetic pole on a magneto rotor driven by an engine, an exciter coil that is wound around said core and induces an AC voltage in synchronization with rotation of said engine, and an ignition coil placed in parallel with said exciter coil and wound around said core, said coil unit is housed in said case with the magnetic pole portion of said core placed outside said case, said ignition unit includes an ignition capacitor, a capacitor charging circuit that charges said ignition capacitor with an output of said exciter coil, a discharge circuit that discharges charges accumulated in said ignition capacitor through a primary coil of said ignition coil when receiving an ignition signal, and an ignition timing control circuit that controls timing for providing said ignition signal to said discharge circuit, and said ignition capacitor and components of said capacitor charging circuit, said discharge circuit and said ignition timing control circuit are mounted to said circuit board, said ignition unit is placed on a lateral side of said coil unit in the case with a surface of said circuit board directed in parallel with an axis of said coil unit, said exciter coil and said ignition coil are placed axially with a spacing therebetween, and a space is formed between the coils, a plurality of ignition coil connection terminals drawn out from said ignition coil for connecting said ignition coil to said circuit board and a plurality of exciter coil connection terminals drawn out from said exciter coil for connecting said exciter coil to said circuit board are drawn out toward said circuit board through the space between said ignition coil and said exciter coil and connected to said circuit board, and said coil unit and said ignition unit are molded with resin poured into said case.

2. The capacitor discharge engine ignition device according to claim 1, wherein the exciter coil is wound around an exciter winding bobbin including a first flange and a second flange at one and the other axial ends, and said exciter winding bobbin is mounted to an outer periphery of said core with said first flange placed on one end side of said core, a primary bobbin having first and second flange portions at one and the other ends is provided, the first flange portion having a larger diameter than the second flange portion, and said primary coil is wound around said primary bobbin, said primary bobbin is mounted to the outer periphery of said core together with said exciter winding bobbin, and said first flange portion faces the second flange of said exciter winding bobbin with a space therebetween, a secondary bobbin including a barrel surrounding said primary coil and the second flange portion of said primary bobbin, and one end side flange portion and the other end side flange portion formed at one and the other axial ends of said barrel is provided, and the secondary coil of the ignition coil is wound around the barrel of said secondary bobbin, said secondary bobbin is placed outside said primary coil, and said one end side flange portion is abutted against the first flange portion of said primary bobbin, said plurality of ignition coil connection terminals and said plurality of exciter coil connection terminals are supported by the first flange portion of said primary bobbin and the second flange of said exciter winding bobbin, respectively, and said plurality of exciter coil connection terminals and said plurality of ignition coil connection terminals are drawn out toward said circuit board through the space between said first flange portion of said primary bobbin and said second flange of said exciter winding bobbin and connected to said circuit board.

3. The capacitor discharge engine ignition device according to claim 2, wherein said primary bobbin integrally includes a boss protruding from a portion closer to said core of said first flange portion toward said exciter winding bobbin, and said boss is abutted against said exciter winding bobbin to maintain the space between the first flange portion of said primary bobbin and the second flange of said exciter winding bobbin.

4. The capacitor discharge engine ignition device according to claim 2, wherein said exciter winding bobbin integrally includes a boss protruding from a portion closer to said core of said second flange toward said primary bobbin, and said boss is abutted against said primary bobbin to maintain the space between the first flange portion of said primary bobbin and the second flange of said exciter winding bobbin.

5. The capacitor discharge engine ignition device according to claim 2, wherein said plurality of exciter coil connection terminals and said plurality of ignition coil connection terminals are drawn out toward said circuit board with tips thereof arranged in line on one plane perpendicular to an axis of said coil unit.

6. The capacitor discharge engine ignition device according to claim 3, wherein said plurality of exciter coil connection terminals and said plurality of ignition coil connection terminals are drawn out toward said circuit board with tips thereof arranged in line on one plane perpendicular to an axis of said coil unit.

7. The capacitor discharge engine ignition device according to claim 4, wherein said plurality of exciter coil connection terminals and said plurality of ignition coil connection terminals are drawn out toward said circuit board with tips thereof arranged in line on one plane perpendicular to an axis of said coil unit.

8. The capacitor discharge engine ignition device according to claim 1, wherein said plurality of ignition coil connection terminals include a primary coil side ground terminal drawn out from one end on a ground side of the primary coil of said ignition coil and a secondary coil side ground terminal drawn out from one end on a ground side of the secondary coil of said ignition coil, and said primary coil side ground terminal and said secondary coil side ground terminal are placed adjacent to each other.

9. The capacitor discharge engine ignition device according to claim 2, wherein said plurality of ignition coil connection terminals include a primary coil side ground terminal drawn out from one end on a ground side of the primary coil of said ignition coil and a secondary coil side ground terminal drawn out from one end on a ground side of the secondary coil of said ignition coil, and said primary coil side ground terminal and said secondary coil side ground terminal are placed adjacent to each other.

10. The capacitor discharge engine ignition device according to claim 3, wherein said plurality of ignition coil connection terminals include a primary coil side ground terminal drawn out from one end on a ground side of the primary coil of said ignition coil and a secondary coil side ground terminal drawn out from one end on a ground side of the secondary coil of said ignition coil, and said primary coil side ground terminal and said secondary coil side ground terminal are placed adjacent to each other.

11. The capacitor discharge engine ignition device according to claim 4, wherein said plurality of ignition coil connection terminals include a primary coil side ground terminal drawn out from one end on a ground side of the primary coil of said ignition coil and a secondary coil side ground terminal drawn out from one end on a ground side of the secondary coil of said ignition coil, and said primary coil side ground terminal and said secondary coil side ground terminal are placed adjacent to each other.

12. The capacitor discharge engine ignition device according to claim 5, wherein said plurality of ignition coil connection terminals include a primary coil side ground terminal drawn out from one end on a ground side of the primary coil of said ignition coil and a secondary coil side ground terminal drawn out from one end on a ground side of the secondary coil of said ignition coil, and said primary coil side ground terminal and said secondary coil side ground terminal are placed adjacent to each other.

* * * * *